US007105126B2

(12) United States Patent
Shoemaker

(10) Patent No.: US 7,105,126 B2
(45) Date of Patent: Sep. 12, 2006

(54) FLAPPER GAS NOZZLE ASSEMBLY

(75) Inventor: Brian C. Shoemaker, Boyertown, PA (US)

(73) Assignee: Vacuum Furnace Systems Corporation, Souderton, PA (US)

( * ) Notice: Subject to any disclaimer, the term of this patent is extended or adjusted under 35 U.S.C. 154(b) by 104 days.

(21) Appl. No.: 10/651,130

(22) Filed: Aug. 28, 2003

(65) Prior Publication Data

US 2005/0046095 A1 Mar. 3, 2005

(51) Int. Cl.
*C21D 1/74* (2006.01)
*C21B 7/16* (2006.01)
*C21D 9/00* (2006.01)

(52) U.S. Cl. ..... 266/250; 266/270

(58) Field of Classification Search ..... 266/249, 266/250, 270

See application file for complete search history.

(56) References Cited

U.S. PATENT DOCUMENTS 2,734,738 A 2/1956 Even
4,285,504 A 8/1981 Colvin
6,533,991 B1 3/2003 Moller
6,756,566 B1 * 6/2004 Moller ..... 266/250
2002/0195439 A1 12/2002 Moller

OTHER PUBLICATIONS

Technical data. Seco/Warwick . Jun. 2001.
Technical data. Abar Ipsen, no date.
Technical data. VFS. Sep. 1998.

* cited by examiner

*Primary Examiner*—Scott Kastler
(74) *Attorney, Agent, or Firm*—Dann Dorfman Herrell and Skillman, P.C.

(57) ABSTRACT

A check valve assembly for the forced gas cooling system of a vacuum heat treating furnace is disclosed. The check valve assembly includes a check valve for installation on the exterior of a hot zone wall in a vacuum heat treating furnace. The check valve includes a valve body forming an inlet, an outlet, and a channel extending longitudinally through the valve body. The valve body has an inner wall that forms a recess near the inlet. The channel contains a flap pivotally supported on a shaft that extends through the recess. The flap pivots in and out of the channel to permit a cooling gas to flow through the valve body in one direction while substantially preventing the flow of gas through the valve body in the opposite direction. The flap is operable between a closed position in which the flap extends into the channel to obstruct the channel, and an open position in which the flap is pivoted out of the channel and into the recess. A vacuum heat treating furnace and a vacuum furnace hot zone utilizing the above-described check valve assembly are also described.

14 Claims, 3 Drawing Sheets

FLAPPER GAS NOZZLE ASSEMBLY

FIELD OF THE INVENTION

The present invention relates to cooling gas systems for vacuum heat treating furnaces, and more specifically to a cooling gas valve assembly for use in such a cooling gas system.

BACKGROUND

In the known vacuum heat treating furnaces, the metallic workload is heat treated in a hot zone and subsequently cooled with a cooling gas. The cooling gas is injected into the hot zone through one or more nozzles that penetrate through the hot zone wall. The nozzles have unobstructed channels that reduce inert gas partial pressure and allow heat to escape from the hot zone during the heating portion of a heat treatment cycle. The gas pressure and heat loss result in poor temperature uniformity around the workpiece. In order to overcome this problem, some vacuum heat treating furnaces include valves or other hardware connected to the cooling gas nozzles on the inside of the hot zone. The valves allow cooling gas to enter into the hot zone through the nozzles, but limit the escape of gas partial pressure and heat through the gas injection nozzles during the heating cycle.

Valves installed in the interior of the hot zone are subject to breaking and wear in a short period of time, because many have moving parts that cannot withstand repeated exposure to the high temperatures in the hot zone. In addition, many of the known valves are formed from materials that cannot withstand such high temperatures. Failure of these devices can create significant down time, because the furnace and hot zone must be opened to access the broken or worn valve. Also, when the valves are arrayed radially about the interior of the hot zone, special measures must be implemented to maintain some of the valves in a closed position because the force of gravity tends to open them. It can be seen that the devices presently used to limit the loss of pressure and temperature from hot zones have limitations that cause them to fall short of the needs of those who operate such furnaces.

SUMMARY OF THE INVENTION

The limitations discussed above are resolved to a significant degree by a check valve assembly for a cooling gas nozzle in accordance with the present invention. The check valve assembly includes a valve body having an inlet, an outlet, and a channel that extends through the valve body between the inlet and the outlet. A chamber is formed in the valve body adjacent to the inlet and in fluid communication with the channel. The chamber has a recess formed therein. The check valve assembly further includes a flap that is pivotally supported in the chamber adjacent the inlet for moving inwardly into the recess of said chamber such that said flap pivots between a closed position where the inlet is closed and an open position in which the channel is not obstructed.

In accordance with another aspect of the present invention, there is provided a vacuum heat treating furnace. The vacuum heat treating furnace according to this invention includes a vacuum vessel having a vessel wall and a hot zone disposed in the vacuum vessel. The hot zone has a hot zone wall and a plenum is formed between the vessel wall and the hot zone wall. A plurality of nozzles extend through the hot zone wall to interconnect the plenum and the hot zone. The vacuum heat treating furnace also has a cooling gas system for providing a forced cooling gas into the plenum and a plurality of check valves, as described above, connected to the nozzles externally of the hot zone wall.

In accordance with a further aspect of the present invention, there is provided a hot zone for a vacuum heat treating furnace. The hot zone according to the present invention includes a closed wall defining an internal volume. Insulation is disposed over an interior surface of the closed wall and a plurality of nozzles are disposed in the closed wall for injecting a cooling gas into the hot zone. The hot zone further includes a plurality of check valves, as described above, each being connected to one of the nozzles and disposed external to the closed wall.

DESCRIPTION OF THE DRAWINGS

The foregoing summary as well as the following description will be better understood when read in conjunction with the drawings in which.

DETAILED DESCRIPTION OF THE PREFERRED EMBODIMENT

Figure 1:
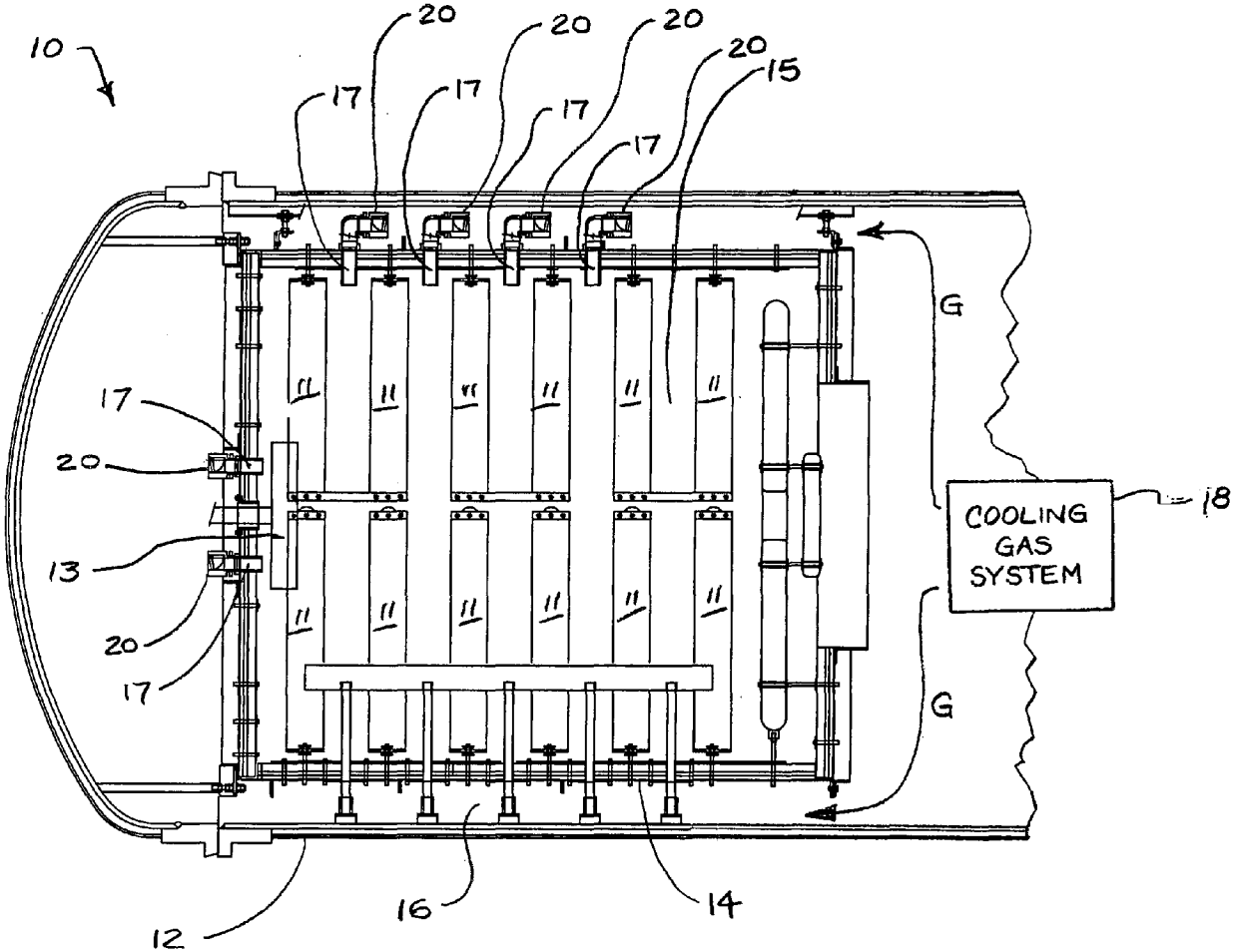
FIG. 1 is a side elevation view of the interior of a vacuum heat treating furnace in accordance with the present invention, with the furnace end wall broken away and the gas cooling system shown schematically.

Referring now to the drawing figures, a vacuum heat treating furnace is shown and designated generally as 10. The heat treating furnace 10 includes a vacuum vessel that has an outer vessel wall 12 and a hot zone wall 14 that forms a hot zone 15. A plenum 16 is formed between the vessel wall 12 and the hot zone wall 14. A plurality of electrical resistance heating elements 11 are positioned within the hot zone and are connectable to a source of electric current. When energized, the heating elements radiate heat within the hot zone 15. The furnace 10 also has a cooling gas system 18 for injecting a cooling gas into the hot zone 15 to cool a work load after it is heat treated.

The hot zone wall 14 has a plurality of nozzles 17 that extend through the hot zone wall. Each nozzle 17 is connected to a check valve assembly 20 that is adapted to receive cooling gas from the cooling gas system 18. The valve assemblies 20 are attached to the exterior of the hot zone wall 14, where the valve assemblies are isolated and insulated from the intense heat generated inside the hot zone. The valve assemblies 20 have inlets that face in a direction for receiving cooling gas from the cooling gas system. Each assembly has an outlet end that is connected to a nozzle 17 for channeling the cooling gas into the nozzle.

Figure 3:
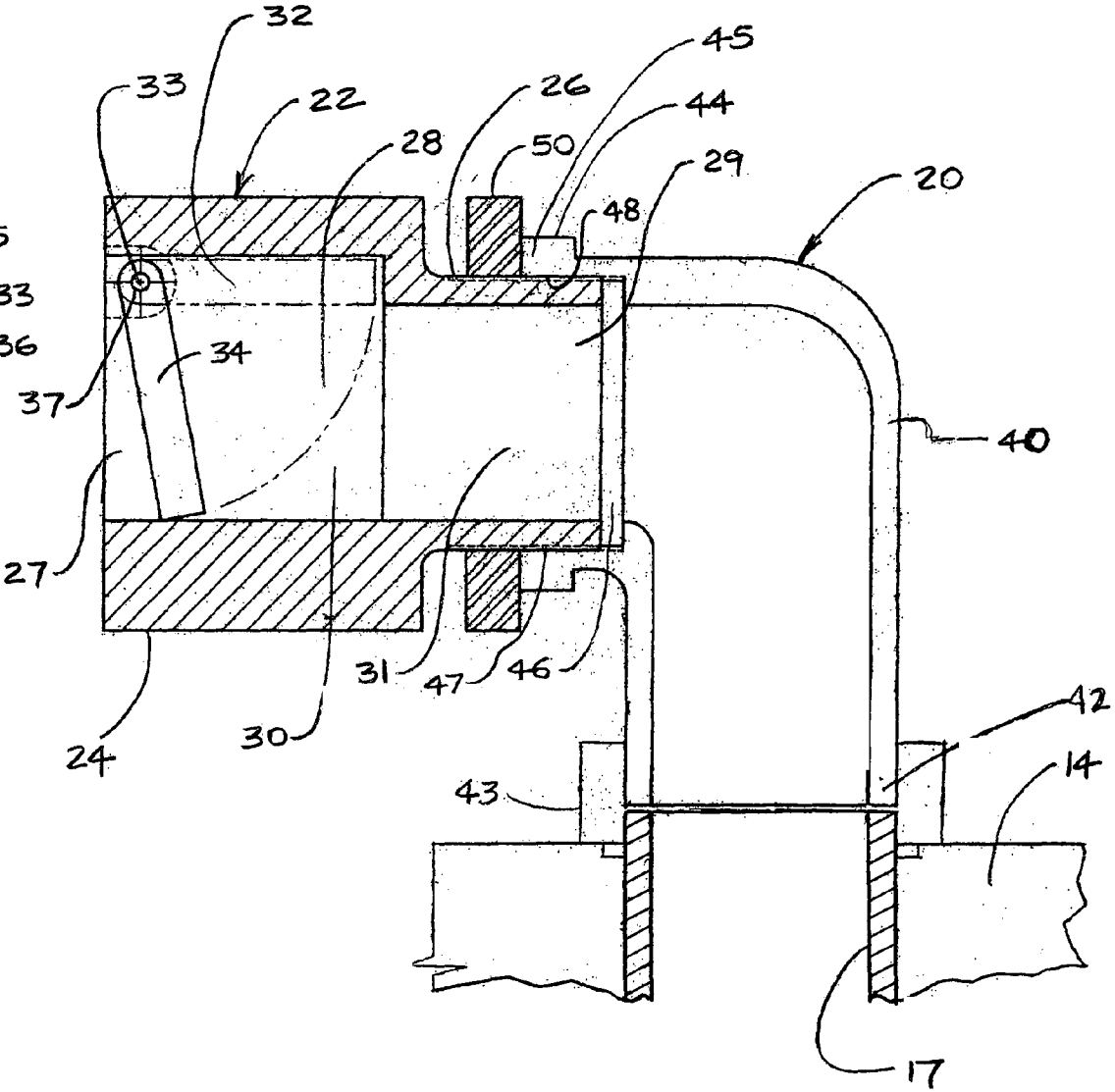
FIG. 3 is a partial sectional side view of a first cooling gas valve assembly used in the vacuum heat treating furnace of FIG. 1.
Figure 2:
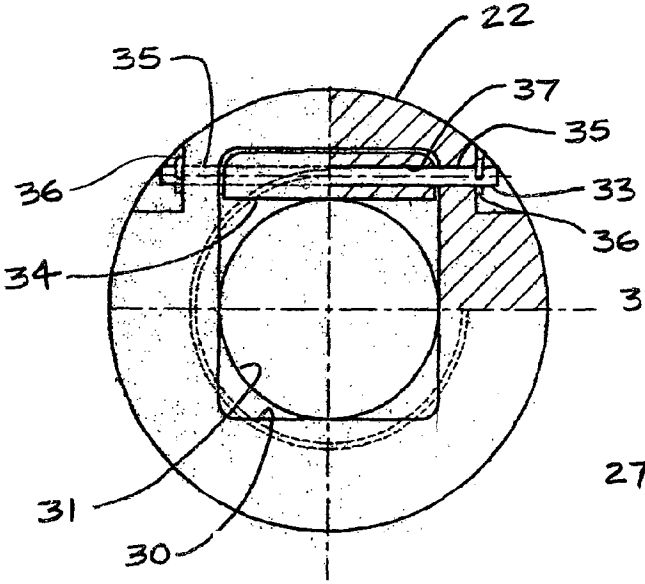
FIG. 2 is a partial sectional end view of a cooling gas check valve used in the vacuum heat treating furnace of FIG. 1.

Referring now to FIGS. 1–3, the furnace 10 and cooling gas valve assemblies 20 will be described in greater detail. The valve assemblies 20 may be used with a variety of hot zone configurations. In FIG. 1, the hot zone wall 14, which is substantially closed, includes a generally cylindrical side wall and a pair of end walls. The hot zone wall 14 and vessel wall 12 are separated by the plenum space 16 that surrounds the exterior of the hot zone wall. The plenum 16 is in fluid communication with the cooling gas system 18.

The cooling gas system 18 is operable to deliver cooling gas under positive pressure through the plenum 16 and into the hot zone 15 through the hot zone wall 14 via the nozzles 17. The valve assemblies 20 are mounted on the cylindrical side wall and may be mounted on one or both end walls of the hot zone wall 14. Each valve assembly 20 is connected with a nozzle 17 to form a fluid channel between the plenum 16 and the hot zone 15. The valve assemblies 20 and nozzles 17 are adapted to receive the cooling gas under positive pressure and convey the cooling gas into the hot zone.

Each valve assembly 20 comprises a valve body 22 as shown in FIGS. 2 and 3. The valve body 22 has a generally cylindrical shape, with a large diameter section 24 and a small diameter section 26 in coaxial alignment with the large diameter section. The valve body 22 is generally hollow and has an internal channel 28 that extends longitudinally through the body. The large diameter section 24 has a first chamber 30 that extends substantially the length of the large diameter section 24 and a second chamber 31 that extends from the chamber 30 through the small diameter section 26. The valve body 22 has an inlet opening 27 formed on one end of the large diameter section 24, and an outlet opening 29 at one end of the small diameter section 26. The inlet opening 27 and outlet opening 29 are interconnected by the channel 28.

Referring now to FIG. 3, the first chamber 30 houses a panel or flap 34 that is pivotally supported on a shaft 33. The shaft 33 is mounted adjacent to inlet 27 in the first chamber 30 and extends generally perpendicularly to the longitudinal axis of the channel 28. The shaft 33 extends through a bore 37 formed in the flap 34 and pivotally supports the flap in the first chamber 30. The flap 34 pivots on the shaft 33 between an open position and a closed position. In the open position, the flap 34 is pivoted into the chamber 30 and into a position generally parallel to the longitudinal axis of the channel. The open position of the flap 34 is illustrated by the dashed lines in FIG. 3. In the closed position, the flap 34 is positioned such that it substantially closes the inlet opening. The closed position of the flap is shown by solid lines. The ends of the shaft 33 are supported in the first chamber 30 by a pair of bores 35 that extend through the body wall on opposite sides of the first chamber. Each bore 35 has a diameter that is slightly larger than the diameter of the shaft 33. As such, the bores 35 permit the shaft 33 to slide axially through the slots. Preferably, the shaft 33 has a means for limiting axial displacement of the shaft in the bores 35 to prevent the shaft from slipping out of the bores. As shown in FIG. 2, the ends of the shaft 33 each have wire or pin 36 that extends through a small diameter hole in the shaft. The lengths of the wires 36 are larger than the diameter of the bores 35 in the body 22. As such, the wires 36 are configured to limit axial displacement of the shaft 20 through the bores 35 to minimize the potential for the shaft to slip out of the body 22.

To optimize the flow rate of cooling gas through the valve assembly, it is desirable to minimize constrictions or abrupt transitions within the channel 28 when the flap 34 is pivoted to the open position. Preferably, the flap 34 is pivoted into chamber 30 when moved to the open position so that the profile of the flap does not obstruct the flow of cooling gas through the channel. Referring again to FIG. 3, the first chamber 30 is formed with an additional space or recess 32 that is adapted to receive the flap when the flap is pivoted to the open position. The first chamber 30 has a generally rectangular cross section, and the second chamber 31 has a generally circular cross section. Three sides of the rectangular cross section of the first chamber 30 are more or less tangential to the circumference of the circular cross section of the second chamber 31, as shown in FIG. 2. In addition, three sides of the rectangular first chamber 30 are generally equidistant from the longitudinal axis of the valve body 22. The fourth side of the first chamber 30 is offset and spaced further away from the longitudinal axis of the valve body 22, forming the recess 32. The recess 32 has dimensions that generally conform to the dimensions of the flap 34 so that the flap fits flush inside the recess when in the open position. In the open position, the front face of the flap 34 is more or less tangential with the circumference of the second chamber 31, as shown in FIG. 2. This provides a smooth transition between the first chamber and the second chamber to reduce turbulence in the cooling gas stream.

The valve assemblies 20 are mounted on the exterior of the hot zone wall 14 so that they are isolated from the heat generated within the hot zone during a heat treatment cycle. Although the valve assemblies 20 are located outside of the hot zone 14, the valve assemblies may still be subject to high temperatures that can affect the performance and service life of the parts in the valve assemblies. Therefore, the components of the valve assembly 20 are preferably formed of durable refractory material that can withstand exposure to high temperatures. Preferably, the valve body 22 and flap 34 are formed of graphite, and the shaft 33 and wires 36 are formed of molybdenum. Alternatively, the components of the valve body 20 may also be formed of ceramic material.

Referring again to FIG. 1, the cooling gas system 18 delivers cooling gas from one end of the furnace 10. The cooling gas system 18 delivers a stream of cooling gas under positive pressure in the plenum space 16, as shown by the arrows labeled "G". Each valve body 22 is mounted on the exterior of the hot zone wall 14 and in the plenum 16 with the inlet opening 27 generally facing into the cooling gas stream. In this way, the valve assemblies 20 can readily capture cooling gas as it passes through the plenum 16. The valve assemblies 20 extending from nozzles 17 on the side wall of the hot zone 15 are fitted with an elbow transition to orient them substantially parallel to the cooling gas stream. In FIG. 1, the valve assemblies 20 mounted on the side wall of the hot zone 15 are connected to the nozzles 17 by ninety degree elbows 40.

The elbows 40 may be connected to the nozzles 17 using a variety of fittings or other connection means. In FIG. 3, an elbow 40 has a first end 42 connected to a nozzle 17 in the hot zone wall 14, and a second end 44 connected to a valve body 22. The nozzle 17 has an inlet end that projects from the hot zone wall 14 to engage with the first end 42 of the elbow 40. The inlet end of the nozzle 17 is coupled to the first end 42 of the elbow 40 with a weld nut 43. The weld nut 43 secures the elbow 40 to the nozzle to hold the elbow in a fixed position relative to the hot zone wall 14. The elbow 40 and weld nut 43 may be formed of steel or other high strength material. The first end 42 of elbow 40 may be secured to the weld nut 43 by tack welds The second end 44 of the elbow 40 has a flanged section 45 configured to connect with the outlet end of the valve body 22. The valve body 22 and elbow 40 may be connected in a variety of ways. In FIG. 3, the flanged end 45 of elbow 40 forms a socket 46. The socket 46 has an inner diameter adapted to receive the small diameter section 26 of the valve body 22. The small diameter section 26 has an external male thread 47 configured to mate with a female thread 48 formed in the interior of the socket 46 when the small diameter section is inserted into the socket and rotated.

The flap 34 is operable in the closed position during a heat treatment cycle to minimize the escape of heat from the hot zone 15 into the plenum 16. When the flap 34 is in the closed position, the flap engages the walls of the first chamber. The cross-sectional shape of the flap 34 is substantially commensurate with the cross sectional shape of the inlet 27. As such, the flap 34 has a rectangular shape that substantially coincides with the sidewalls of the first chamber when the flap is in the closed position to effectively close the inlet opening 27.

The rectangular flap 34 has a pair of long sides and a pair of short sides, as shown in FIG. 2. Similarly, the cross-section of the first chamber 30 has a pair of long sides and a pair of short sides corresponding to the long and short sides of the flap 34. The flap 34 is mounted over the shaft 33 with the shaft extending generally parallel to the short sides of the flap. The short sides of the flap 34 are slightly smaller in length than the short sides of the first channel section 30, forming a small clearance space between the long sides of the flap 34 and long sides of the channel. The clearance space is dimensioned to permit the flap 34 to freely pivot on the shaft 33 between the open and closed positions, while minimizing frictional contact between the long sides of the flap and channel wall. Preferably, the amount of clearance space is minimized to limit the flow of gas around the flap 34 when the flap is in the closed position. The valve body 22 and locking ring 50 are preferably formed of graphite.

The valve body 22 is positioned so that the flap 34 is oriented with its short sides being generally horizontal and the long sides being generally vertical. In addition, the shaft 33 is preferably positioned horizontally at the upper end of the flap. In this orientation, referred hereinafter as the "upright position", the flap 34 is biased toward the closed position by the force of gravity. The long sides of the flap 34 are preferably commensurate in length with the long sides of the first chamber 30. In this way, the bottom end of the flap 34 contacts the bottom wall of the first chamber 30 in frictional engagement. The frictional engagement between the bottom end of the flap 34 and the bottom wall of the first chamber 30 forms a partial seal along the bottom end of the flap 34 when the flap is in the closed position.

Partial pressures of inert gas may develop in the hot zone 15 during a convection heating cycle, causing the build up of pressure that pushes outwardly on each flap 34. The frictional engagement between the bottom end of the flap 34 and the bottom wall in the first chamber 30 is sufficient to prevent the flap from pivoting outwardly past the closed position. This minimizes the loss of heat from the hot zone during the heating cycle, as discussed below in connection with the operation of the invention.

The valve body 22 is configured to mate with the flanged end 45 of the elbow 40, as discussed earlier. The smaller diameter section 26 is rotatable in the flanged end 45 to connect the male thread 47 in the valve body with the female thread in the socket 46. A locking ring 50 surrounds the smaller diameter section and is configured to securely lock the elbow and flap in the upright position when the valve body 22 is connected to the elbow. The locking ring 50 has a bore with female threading that mates with the male thread 47 on the smaller diameter section 26 of the valve body 22. When the smaller diameter section 26 is inserted into the socket 46 of elbow 40, the locking ring is rotatable on the smaller diameter section to displace the locking ring into abutting engagement with the flange 45. The locking ring 50 is further rotatable as it abuts the flange 45 to tighten the engagement between the valve body and the elbow. In particular, the locking ring 50 is rotatable against the flange to tighten the engagement between the threads on the small diameter section 26 and in the socket. The tightened engagement between the threads limits rotational displacement of the valve body 22 relative to the elbow, securing the orientation of the valve body so that the flap is retained in the proper orientation for receiving the cooling gas flow.

Figure 4:
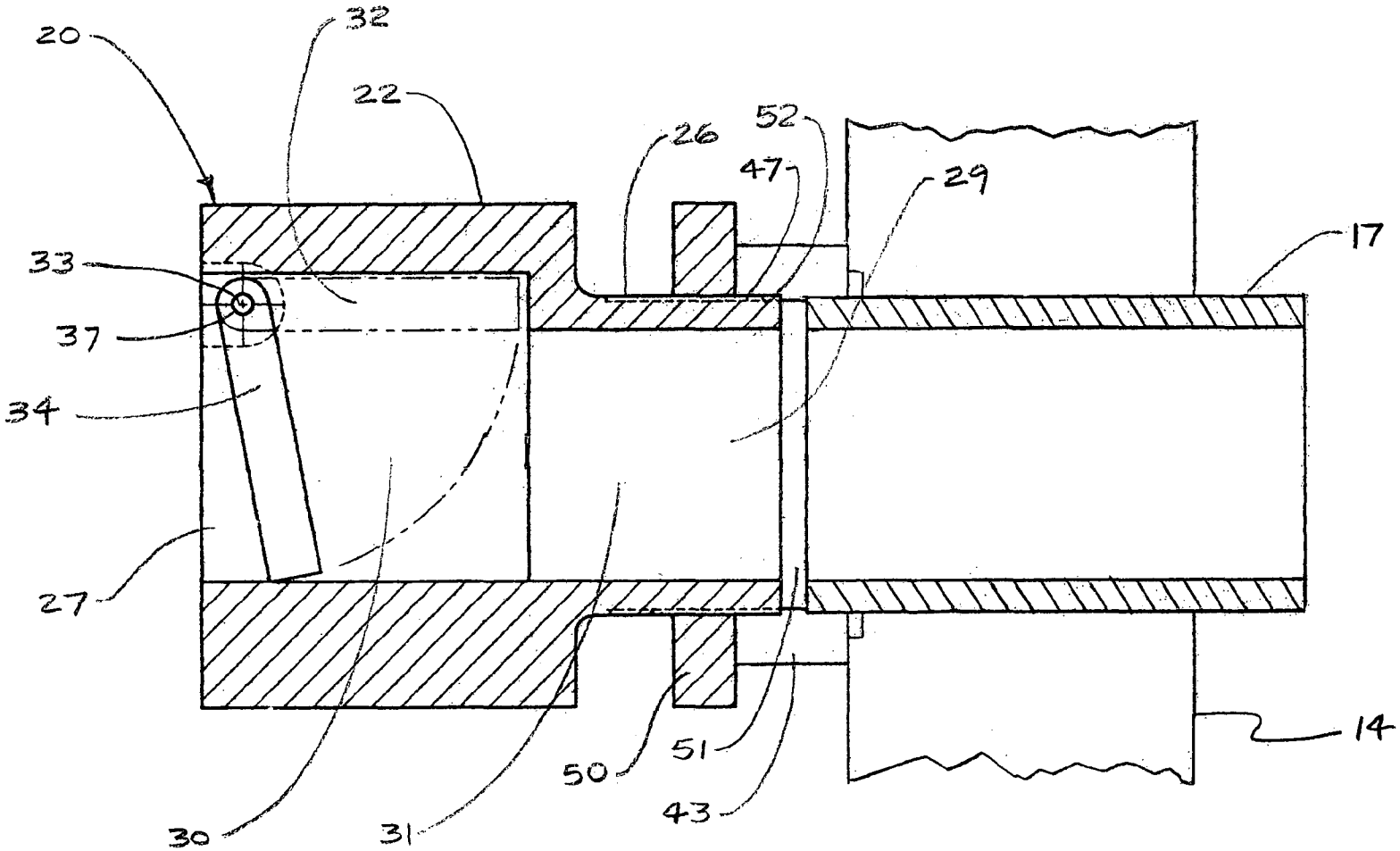
FIG. 4 is a partial sectional side view of a second cooling gas valve assembly used in the vacuum heat treating furnace of FIG. 1.

Valve assemblies 20 that are disposed on one or both of the end walls of the hot zone 15 receive cooling gas flow from different directions in the plenum depending on their location. As shown in FIG. 1, the valve assemblies on the end walls of the hot zone extend outwardly into the plenum. Referring now to FIG. 4, the valve assemblies 20 located on an end wall of the hot zone 15 generally comprise the same components as valve assemblies on the side wall of the hot zone, but without the elbow fitting. The small diameter section 26 of the valve body 22 is connected directly to the nozzle 17 in the hot zone wall. The nozzle 17 has an inlet end that projects from the hot zone wall 14. The inlet end of the nozzle 17 is coupled to the small diameter section 26 of the valve body 22 by a weld nut 43 having an interior bore 51. The bore 51 is adapted to receive the small diameter section 26 of the valve body 22 and the inlet end of the nozzle 17. As described above, the small diameter section 26 of the valve body 22 has an external male thread 47. The male thread 47 is configured to mate with a female thread 52 that extends in the bore 51 of weld nut 43. The inlet end of the nozzle 17 may be connected to the weld nut 43 using a variety of connection means, including but not limited to a threaded connection or welding.

A locking ring 50 surrounds the smaller diameter section 26 of the valve body 22, similar to the valve assemblies on the side wall of the hot zone. The locking ring 50 is configured to securely lock the valve body 22 and flap 34 in the upright position when the valve body is connected to the weld nut 43. The locking ring 50 has a bore with female threading that mates with the male thread 47 on the smaller diameter section 26 of valve body 22. When the smaller diameter section 47 is inserted into the weld nut 43, the locking ring is rotatable on the smaller diameter section to displace the locking ring into abutting engagement with the weld nut 43. The locking ring 50 is further rotatable as it abuts the weld nut 43 to tighten the engagement between the threads on the valve body and the elbow. The locking ring 50 is operable to secure the orientation of the valve body 22 so that the flap 34 is retained in the upright position.

Referring back to FIG. 1, the operation of the valve assembly 20 will now be described. During the heating cycle in the furnace 10, the heating elements 11 in hot zone 15 are energized and generate heat to raise the temperature in the hot zone. An internal fan 13 is activated to circulate the atmosphere in the hot zone 15, thereby providing convection heating of the workpieces. During this time, the flap 34 in each valve assembly 20 is biased in the closed position by gravity, thereby closing off channel 28 to substantially prevent the escape of heat through the nozzles 17 during the heating cycle.

After the heating cycle is completed, the heating elements 11 are de-energized, and the cooling gas system 18 is operated to fill the hot zone 15 with a quenching or cooling gas. The cooling gas system 18 forces the cooling gas into the plenum 16 and around the hot zone wall 14 under positive pressure. The positive pressure exerts inward force on the closed flaps 34 in the cooling valve assemblies 20. The inward force on the flap 34 is significantly larger than the gravitational force that holds the flap in the closed position. As a result, the positive pressure pushes the flaps 34 inwardly, pivoting the flaps into the recesses in the respective first chambers of each valve. In the manner, the channels 28 are no longer obstructed by the flaps 34, and cooling gas flows through the channels and through the nozzles 17 into the hot zone 15.

As the stream of cooling gas passes through each valve assembly 22, the pressure in the gas stream bears against the flap 34 and maintains the flap in the open position. Cooling gas is exhausted from the hot zone to maintain a pressure differential between the plenum 16 and the hot zone 15. When the cooling cycle is completed, the cooling gas system 18 shuts off the flow of cooling gas. The pressures in the plenum 16 and hot zone 15 gradually drop until the two pressures approach equilibrium. As the net positive pressure in the plenum drops below a threshold value, the inward force on the flap 34 decreases until it no longer is sufficient to overcome the gravitational force that biases the flap toward the closed position. Thereafter, the flap 34 pivots or drops to the closed position.

The terms and expressions which have been employed are used as terms of description and not of limitation. There is no intention in the use of such terms and expressions of excluding any equivalents of the features shown and described or portions thereof. It is recognized, therefore, that various modifications are possible within the scope and spirit of the invention. Accordingly, the invention incorporates variations that fall within the scope of the following claims.

I claim:

1. A vacuum heat treating furnace comprising:

A. a vacuum vessel having a vessel wall;

B. a hot zone disposed in said vacuum vessel, said hot zone having a hot zone wall;

C. a plenum formed between the vessel wall and the hot zone wall;

D. a plurality of gas injection nozzles extending through the hot zone wall to interconnect the plenum and the hot zone;

D. a cooling gas system for providing a forced cooling gas into the plenum; and

E. a plurality of check valves connected to the gas injection nozzles externally of the hot zone wall, each of said plurality of check valves comprising:

i. a valve body having an inlet portion, an outlet portion, and a channel that extends through the valve body between the inlet portion and the outlet portion;

ii. a chamber formed in the inlet portion of said valve body, said chamber encompassing the channel and having a recess formed therein adjacent to said channel; and iii. a flap that is pivotally supported in said chamber such that said flap is adapted to swing toward the outlet portion of said valve body, said flap having a closed position whereby the channel is closed to the flow of cooling gas and an open position whereby the channel is open to the flow of cooling gas and said flap is located substantially within the recess in said chamber.

2. The vacuum heat treating furnace of claim 1, wherein the valve body and the flap are formed of graphite or a ceramic material.

3. The vacuum heat treating furnace of claim 2, wherein the shaft is formed of molybdenum.

4. The vacuum heat treating furnace of claim 1, wherein the flap has a shape that substantially conforms with the shape of the recess, said flap being configured to rest in the recess flush with a wall of the channel when the flap is in the open position.

5. A hot zone for use in a vacuum heat treating furnace comprising:

A. a closed wall defining an internal volume;

B. insulation means disposed over an interior surface of said closed wall;

C. a plurality of gas injection nozzles disposed in said closed wall for injecting a cooling gas into the hot zone; and D. a plurality of check valves each being connected to one of the gas injection nozzles externally of the closed wall, each of said check valves comprising:

i. a valve body having an inlet portion, an outlet portion, and a channel that extends through the valve body between the inlet portion and the outlet portion;

ii. a chamber formed in.the inlet portion of said valve body, said chamber encompassing the channel and having a recess formed therein adjacent to said channel; and iii. a flap that is pivotally supported in said chamber such that said flap is adapted to swing toward the outlet portion of said valve body, said flap having a closed position whereby the channel is closed to the flow of cooling gas and an open position whereby the channel is open to the flow of cooling gas and said flap is located substantially within the recess in said chamber.

6. The hot zone set forth in claim 5, wherein each of the check valves comprises a shaft for supporting said flap, said shaft extending through an edge of said flap and having end portions supported by the valve body in said chamber.

7. The hot zone set forth in claim 5, wherein the valve body and the flap are formed of a refractory material.

8. The hot zone set forth in claim 5, wherein the valve body and the flap are formed of graphite or a ceramic material.

9. The hot zone set forth in claim 6, wherein the shaft is formed of molybdenum.

10. The hot zone set forth in claim 5, wherein the flap is dimensioned to fit entirety within the recess.

11. The vacuum heat treating furnace of claim 1 further comprising a coupling connected between the outlet portion of each of said plurality of check valves and to each of the plurality of gas injection nozzles.

12. The vacuum heat treating furnace of claim 11 wherein said coupling is an elbow coupling.

13. The vacuum heat treating furnace of claim 5 further comprising a coupling connected between the outlet portion of each of said plurality of check valves and to each of the plurality of gas injection nozzles.

14. The vacuum heat treating furnace of claim 13 wherein said coupling is an elbow coupling.

* * * * *